United States Patent [19]

Rossman

[11] Patent Number: 4,790,085

[45] Date of Patent: Dec. 13, 1988

[54] THRUST COUPLING FOR A VEHICLE

[75] Inventor: Michael Rossman, Beuerberg, Fed. Rep. of Germany

[73] Assignee: Rossman Research, Phoenix, Ariz.

[21] Appl. No.: 48,326

[22] Filed: May 11, 1987

[30] Foreign Application Priority Data

May 27, 1986 [DE] Fed. Rep. of Germany ..... 3617708

[51] Int. Cl.[4] ..... E01H 5/08

[52] U.S. Cl. ..... 37/231; 37/232; 172/273; 172/817

[58] Field of Search ..... 37/231, 232; 172/817, 172/829, 830, 831, 272, 273, 246

[56] References Cited

U.S. PATENT DOCUMENTS

| | | | |
|---|---|---|---|
| 4,354,321 | 10/1982 | Weatherholt | 37/231 |
| 4,470,211 | 9/1984 | Rossmann | 37/231 |
| 4,658,519 | 4/1987 | Quenzi | 37/231 |

*Primary Examiner*—David A. Wiecking
*Assistant Examiner*—Moshe I. Cohen
*Attorney, Agent, or Firm*—Kenyon & Kenyon

[57] ABSTRACT

The thrust coupling has a thrust frame formed of three tubular sections which is mounted on the underside of a vehicle. The front of the thrust frame is suspended by chains from the front of the vehicle and can be raised and lowered by hydraulic cylinders connected to cross arms attached to the chains. The rear of the thrust frame is connected by a parallelogram arrangement of links in which a shock absorber is connected to dampen motion of the parallelogram arrangement of links.

15 Claims, 2 Drawing Sheets

THRUST COUPLING FOR A VEHICLE

This invention relates to a thrust coupling for a vehicle and particularly to a thrust coupling for attaching a snow plow blade or the like to a vehicle.

Thrust couplings have been known, for example as described in U.S. Pat. No. 4,470,211 for the mounting of snow plow blades, scrapper blades, sweeping brushes and the like at the front end of a vehicle. In such cases, the thrust coupling has a frame which can be disposed below a vehicle, a means at the rear end of the frame for suspending the frame from a hitching device at the rear of the vehicle and means at the front end of the frame for securing the frame to the vehicle at the front end. In addition, the frame can be braced to the chassis of the vehicle by means of a lateral strut. Such a thrust coupling is particularly suitable for passenger automobiles since shear forces in the chassis are minimal and practically no modification need be made to allow attachment of the coupling. For example, it is sufficient to attach a single pin clip to any point on the front of the chassis in order to connect the lateral strut. Further, suspension of the thrust coupling from the vehicle chassis can be accomplished using chains and hooks or shackles which can be hooked anywhere onto the chassis or bumper of the vehicle.

In some cases, malfunctioning of a thrust coupling can occur due to ice and dirt, for example, once the thrust frame has been mounted in position. Further, the connection of the lateral strut to the vehicle chassis may prevent longitudinal movement of the frame so that longitudinal thrust forces on the frame are transmitted directly to the hitching device at the rear of the vehicle, for example where there is a sudden thrust shock or blow as may occur during snow plowing at the front of the vehicle.

Accordingly, it is an object of the invention to provide an improved thrust coupling for a vehicle.

It is another object of the invention to damp sudden thrust shocks in a thrust coupling before transfer to a hitching device of a vehicle.

It is another object of the invention to reduce malfunctioning of a thrust coupling due to icing.

Briefly, the invention provides a thrust coupling for mounting on a vehicle having a chassis or support frame at the front and a hitching device at the rear. The coupling device includes a thrust frame for disposition under the vehicle support frame, a means at the rear of the thrust frame for suspending the thrust frame from the hitching device of the vehicle, means at the front end of the frame for suspending the frame from the vehicle support frame and means at the front end of the thrust frame for moving the thrust frame vertically relative to the vehicle frame.

The means for moving the thrust frame vertically include a pair of cross arms which are pivotally mounted on the thrust frame and a pair of hydraulic pistons each of which is connected between the thrust frame and a respective cross arm for vertically pivoting the cross arm. When actuated, the hydraulic pistons cause the cross arms to pivot, thus causing a suspended thrust frame to be raised or lowered. In this case, the thrust frame may be suspended by a pair of chains or the like which are connected between the ends of the cross arms and a fixed part of the vehicle chasis or support frame.

Each cross arm may also be pivotally mounted, for example, on a block mounted on the thrust frame so as to allow horizontal movement of the thrust frame under impact forces. In this respect, a lateral strut is also pivotally connected to the block and has a distal end for connection to the vehicle support frame.

The means at the rear end of the thrust frame for suspending the thrust frame from the hitching device includes a damper for damping a longitudinal movement of the thrust frame relative to the vehicle support frame. In this respect, the suspending means may be in the form of a parallelogram arrangement of links with the damper in the form of a spring loaded shock absorber connected within the links in order to damp a motion of the links under an applied thrust force.

The suspending means at the rear of the thrust frame may also be rotatable about a longitudinal axis of the thrust frame between a horizontally disposed position so as to lie flat on a ground surface and a vertically disposed position so as to be suspended from the hitching device of the vehicle.

These and other objects and advantages of the invention will become more apparent from the following detailed description taken in conjunction with the accompanying drawings wherein.

Figure 1:
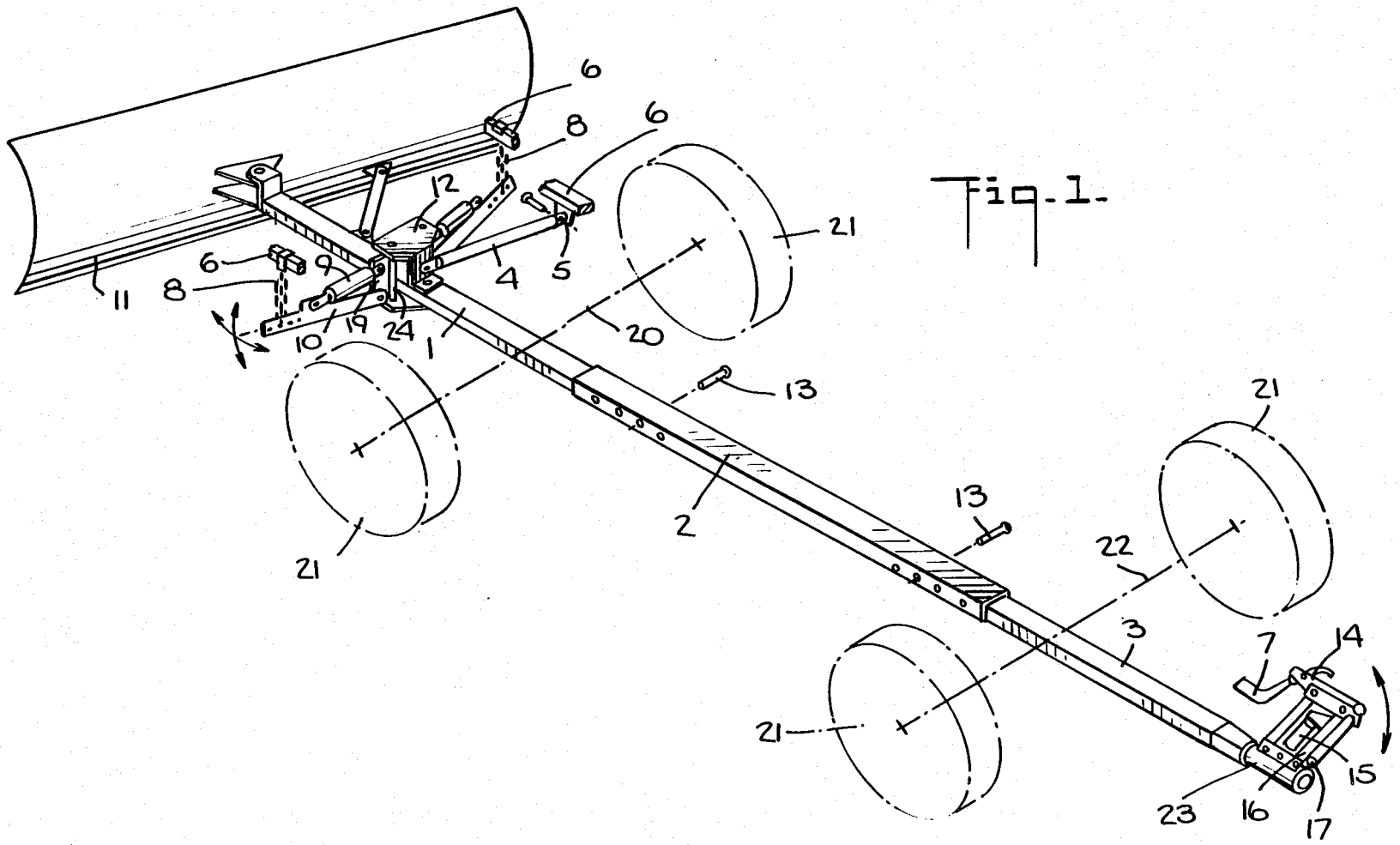
FIG. 1 illustrates a perspective view of a thrust coupling constructed in accordance with the invention.

Referring to FIG. 1, the thrust coupling is constructed for attachment to the underside of a vehicle. To this end, the vehicle is shown schematically.

The thrust coupling has an elongated thrust frame formed of three interfitting tubular sections 1, 2, 3 which are coupled together via pins 13. In this respect, several cross holes are provided in the tubular sections 1, 2, 3 in order to allow accommodations to various vehicle lengths. The forwardmost section 1 carries a suitable mounting lug or the like to which a snow plow mold-board 11 can be attached. Alternatively, other implements may be attached to the tubular section 1 such as a brush, snow blower or the like.

The vehicle includes a front axle 20 and a rear axle 22, each of which carries a pair of wheels 21. In addition, the vehicle has a support frame or chassis 6 at the front and a hitching device 7, for example in the form of a trailer hitch, at the rear.

The thrust coupling includes a means at the rear end of the thrust frame for suspending the frame from the hitching device 7. As illustrated, this means includes a parallelogram arrangement of links 16 with a spring loaded shock absorber 15 located within the parallelogram arrangement. The interconnection of the shock absorber 15 is such that as the parallelogram arrangement 16 is distorted, the shock absorber 15 dampens any motion.

As illustrated, the parallelogram arrangement of links 16 is connected on the upper side to an end 14 of the trailer hitch 7 while a sleeve 23 is provided on the lower end to fit over a circular tail piece of the rearmost tubular section 3 of the thrust frame. The parallelogram arrangement 16 can thus freely rotate about the axis of the tubular section 3. A spring loaded drop pin 17 is also used to lock the sleeve 23 to the tail piece.

Prior to attachment to the vehicle, the parallelogram arrangement of links 16 is able to pivot about the thrust frame 1, 2, 3 between a horizontally disposed position lying flat on a ground surface and a vertically disposed position so as to be suspended from the hitching device 7. When lying flat on the ground, the parallelogram arrangement of links 16 may be driven over without causing any damage. Once attached, the parallelogram arrangement rests in a slightly slanted position providing clearance between the thrust frame 1, 2, 3 and the differential (not shown) of the vehicle by the off-center position Referring to FIGS. 1 and 2, a means is provided at the front end of the thrust frame 1, 2, 3 for suspending the thrust frame from the vehicle support frame 6. As indicated, this means is in the form of a pair of chains or cables 8. Also, as indicated, these chains or cables 8 cooperate with a means at the front end of the thrust frame 1, 2, 3 for moving the thrust frame 1, 2, 3 vertically relative to the vehicle frame 6.

The means for moving the thrust frame 1, 2, 3 vertically includes a hinge block 12 which is mounted, as by bolting, to the foremost tubular section 1 in order to permit mounting in various longitudinally disposed positions. The block 12 has a pair of vertically disposed plates 19 which are hingedly mounted by hinge pins 24 on opposite sides of the block 12. In addition, a cross arm 10 is pivotally mounted on each hinge plate 19 on a horizontal axis while a hydraulic piston 9 or the like is connected to and between a hinge plate 19 and a cross arm 10 for vertically pivoting the cross arm 10. Each hinge plate 19 also permits a horizontal hinge motion of a respective cross arm 10. In addition, each cross arm 10 has a plurality of bores at the distal end to receive a chain 8 in a selective manner.

A lateral strut 4 is also pivotally connected to the block 12 via a universal movement means such as a ball joint while also being pivotally connected via a ball joint to the support frame 6. As indicated, a tab 5 is provided at the distal end of the strut 4 so as to be secured to the support frame 6 via a bolt 18.

The mounting cf the thrust frame at the front end to the vehicle is such as to provide for both vertical and horizontal movement of the thrust frame 1, 2, 3 relative to the vehicle. Vertical movement is accomplished by activating the hydraulic cylinders 9 thus varying one side of the triangle formed by a respective cylinder 9, cross arm 10 and hinge plate 19. The horizontal movement cf the thrust frame parallel to the axis of the thrust frame is free and only restrained by the shock absorber 15.

Figure 2:
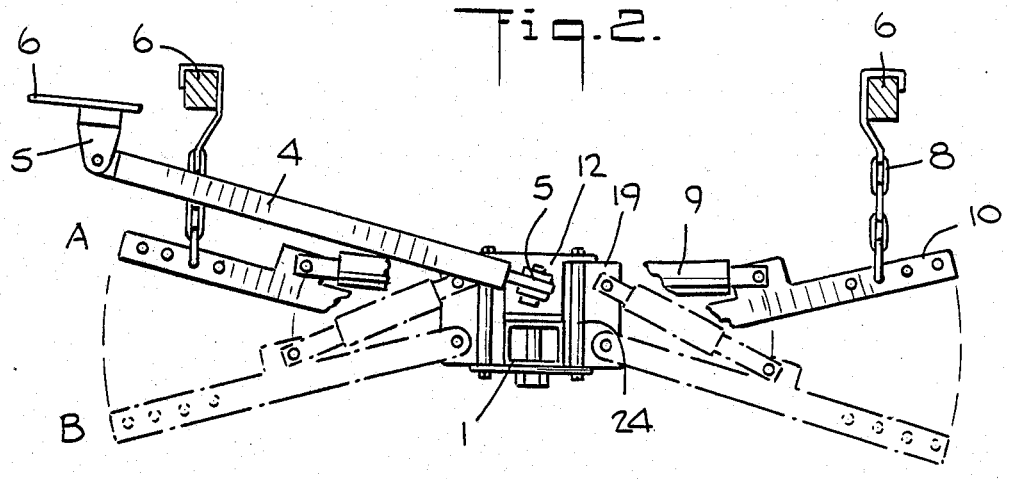
FIG. 2 illustrates a front view of the cross arms and strut of the thrust coupling of FIG. 1.

Referring to FIG. 2, the hydraulic cylinders 9 are such as to be able to move the respective cross arms 10 between a raised position A and a lowered position B. In the raised position A, the entire thrust frame rests on the ground and a vehicle may be driven on top of the frame in preparation for attachment. Once the vehicle is in position, the cross arms 10 are connected to the vehicle chassis or support frame 6 via the chains 8. The bores in the arms 10 permit adaptation to various widths of chassis. The parallelogram arrangement of links 16 may be engaged prior to or after the front connection. In order to complete the attachment, the distal end of the lateral strut 4 is connected to the support frame 6 via the tab 5 and bolt 18.

Once attachment is complete, the hydraulic cylinders 9 are activated to force the cross arms 10 into the lowered position B. This raises the thrust frame 1, 2, 3 from the ground. In the fully raised position, the thrust frame 1,2,3 makes contact with the vehicle chassis at a predefined point. In order to commence snow plowing, the pressure in the hydraulic cylinders 9 is released so that the mold board 11 (see FIG. 1) drops down and makes contact with the ground.

Figure 3:
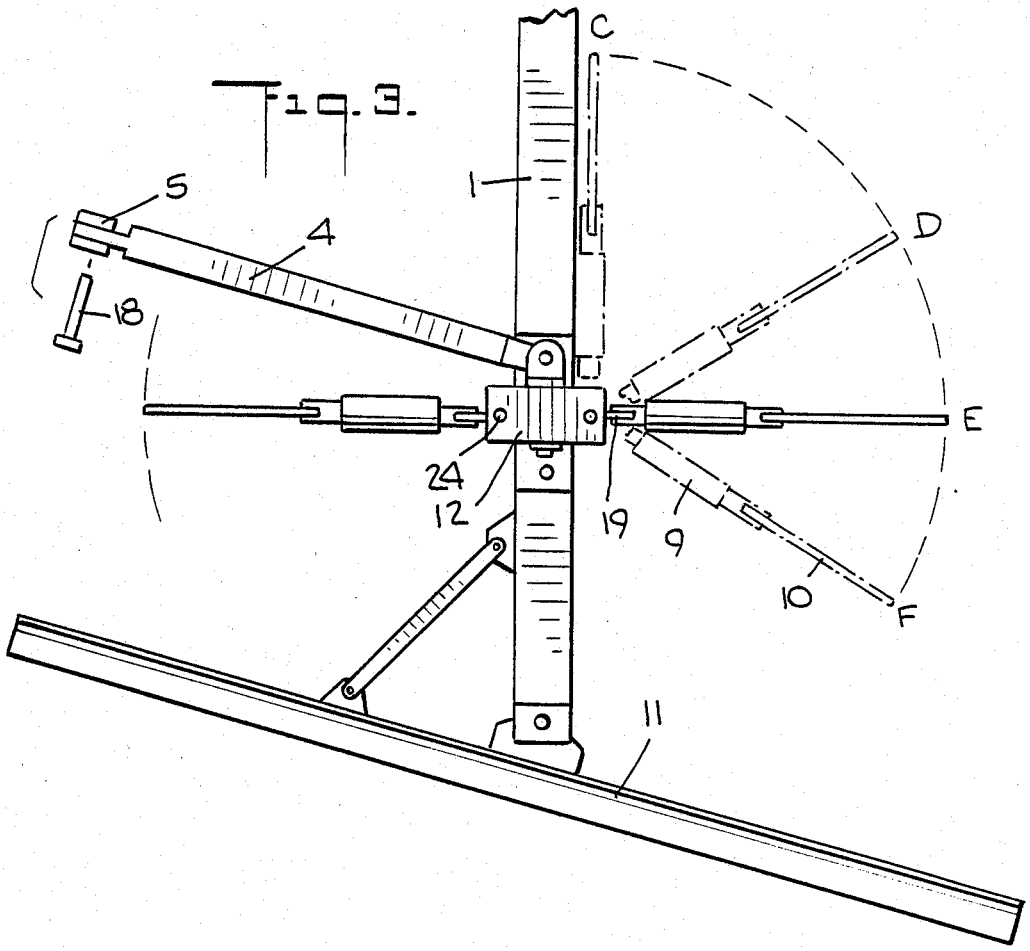
FIG. 3 illustrates a plan view of the front end of the thrust coupling with a snow plow mold-board in place.

Referring to FIG. 3, when in a normal operating position E, the cross arms 10 are perpendicular to the foremost tubular section 1. When in a packaged position C, each cross arm 10 lies in parallel with the foremost tubular section 1. Each cross arm 10 is also pivotable between a rearmost position D and a forwardmost position F due to sudden resistance or excessive thrust compressing the shock absorber 15 (not shown).

The suspension of the thrust frame from the chassis so as to be able to move freely parallel to the vehicle motion provides a physical separation of the thrust frame 1, 2, 3 from the front of the vehicle chassis 6. Therefore, no sudden thrust shocks or blows, as are common in snow plowing, are impacted on the front of the chassis. Instead, such forces are first dampened within the parallelogram arrangement of links 16 and then transmitted to the rear of the chassis in a manner intended by the trailer hitch 7.

In addition, icing problems are greatly reduced by alternating actions of a force lifting the thrust frame 1, 2, 3 and mold board and gravity lowering the thrust frame and board.

Of note, as an alternative to suspending the thrust frame via chains or cables, use may be made of solid rods. Further, the cross arms can be suspended from a bumper or other structural component of a vehicle.

The invention thus provides a thrust coupling of improved construction which is able to damp thrust forces prior to transfer to a hitching device at the rear of a vehicle.

Further, the invention provides a mounting arrangement for a thrust frame which permits longitudinal movement of the thrust frame relative to a vehicle support frame or chassis.

Still further, the invention provides an arrangement whereby a thrust frame can be raised and lowered vertically in order to break free of ice or dirt which might otherwise impair the proper operation of the thrust frame.

What is claimed is:

1. A thrust coupling for a vehicle having a support frame and a hitching device at a rear of the support frame, said thrust coupling comprising a thrust frame for disposition under the support frame of the vehicle;

first means at a rear end of said thrust frame for suspending said thrust frame from the hitching device of the vehicle;

second means including a strut mounted with universal movement means at each end at a front end of said thrust frame for suspending said thrust frame from the vehicle support frame while permitting free horizontal movement parallel to said vehicle frame; and third means at said front end of said thrust frame for moving said thrust frame vertically relative to the vehicle frame.

2. A thrust coupling as set forth in claim 1 wherein said third means includes a pair of cross arms pivotally mounted on said thrust frame and connected to said second means and a pair of hydraulic pistons, each piston being connected to and between said thrust frame and a respective one of said cross arms for vertically pivoting said respective cross arms.

3. A thrust coupling as set forth in claim 2 wherein said second means includes a pair of chains, each said chain being connected to a respective one of said cross arms.

4. A thrust coupling as set forth in claim 2 wherein said third means includes a block mounted on said thrust frame and a pair of vertically disposed plates hingedly mounted in opposite sides of said block, each said plate having a respective one of said cross arms pivotally mounted thereon on a horizontal axis.

5. A thrust coupling as set forth in claim 4 wherein said strut is pivotally connected to said block.

6. A thrust coupling as set forth in claim 1 wherein said third means is movably mounted on said thrust frame to permit longitudinal movement of said thrust frame relative to the vehicle frame.

7. A thrust coupling as set forth in claim 6 wherein said first means includes a damper for damping a longitudinal movement of said thrust frame relative to the vehicle frame.

8. A thrust coupling as set forth in claim 1 wherein said first means includes a damper for damping a longitudinal movement of said thrust frame relative to the vehicle frame.

9. A thrust coupling as set forth in claim 1 wherein said first means includes a parallelogram arrangement of links for suspending said thrust frame from hitching device.

10. A thrust coupling as set in claim 9 wherein said first means includes a spring loaded shock absorber connected within said links to damp a motion of said links.

11. A thrust coupling comprising an elongated thrust frame; and a means at a rear end of said frame for suspending said frame from a hitching device of a vehicle, said means being rotatable about a longitudinal axis of said frame between a first horizontally disposed position to lie flat on a ground surface and a second vertically disposed position to be suspended from the hitching device of a vehicle, said means including a parallelogram arrangement of links for suspending said thrust frame from the hitching device and a damper for damping a motion of said links.

12. A thrust coupling as set forth in claim 11 wherein said damper is a spring loaded shock absorber connected within said links to damp a motion of said links.

13. A thrust coupling comprising an elongated thrust frame;

a parallelogram arrangement of links at a rear end of said frame for suspending said frame from a hitching device of a vehicle;

a block mounted on a front end of said frame;

a pair of cross arms articulated to opposite sides of said block, each arm being pivotal about a vertical axis relative to said block and being pivotal about a horizontal axis relative to said block;

a pair of pistons, each piston being connected between said block and a respective cross arm for pivoting said respective cross arm vertically relative to said block;

means at an end of each cross arm for suspending said cross arms from a vehicle frame; and a strut pivotally connected to said block and having a distal end for pivotal connection to the vehicle frame.

14. A thrust coupling as set forth in claim 13 which further includes a spring loaded shock absorber connected within said links to damp a motion of said links.

15. A thrust coupling as set forth in claim 13 wherein each said piston is a hydraulic piston.

* * * * *

UNITED STATES PATENT AND TRADEMARK OFFICE

CERTIFICATE OF CORRECTION

PATENT NO. : 4,790,085

DATED : Dec. 13, 1988

INVENTOR(S) : Michael Rossmann

It is certified that error appears in the above-identified patent and that said Letters Patent is hereby corrected as shown below:

Column 3, line 47 "cf" should be -of-
Column 5, line 27 "hitching" should be -the hitching- Signed and Sealed this Twenty-seventh Day of June, 1989

*Attest:*

DONALD J. QUIGG

*Attesting Officer*

*Commissioner of Patents and Trademarks*